United States Patent [19]

Fretwell, Jr.

[11] 4,270,477

[45] Jun. 2, 1981

[54] DEVICE FOR THE ACCELERATED LAUNCHING OF LIGHT SAILS

[76] Inventor: Jack W. Fretwell, Jr., 13354 Feldman Pl., Herndon, Va. 22070

[21] Appl. No.: 940,166

[22] Filed: Sep. 7, 1978

[51] Int. Cl.[3] ..... B63H 9/10

[52] U.S. Cl. ..... 114/104

[58] Field of Search ..... 114/39, 102, 103, 104, 114/105, 106, 107, 111; 116/173, 174

[56] References Cited

U.S. PATENT DOCUMENTS

| | | | |
|---|---|---|---|
| 2,595,110 | 4/1952 | Steube et al. | 114/104 |
| 3,861,343 | 1/1975 | Fretwell, Jr. | 114/104 |
| 4,102,289 | 7/1978 | Ebbeson et al. | 114/104 |

FOREIGN PATENT DOCUMENTS

| | | | |
|---|---|---|---|
| 889424 | 12/1971 | Canada | 116/173 |
| 1528103 | 10/1978 | United Kingdom | 114/104 |

OTHER PUBLICATIONS

Svensson; "Device for Simplifying the Setting and Taking in of Sails"; May 17, 1979; Publication No. WO 79/00272.

*Primary Examiner*—Charles E. Frankfort

[57] ABSTRACT

Device for accelerating the launching of light sails comprising a set of smooth rings encircling the furled sail at intervals along its length and an elastic spacing line extending between the rings and between the uppermost ring and the top of the sail.

8 Claims, 3 Drawing Figures

DEVICE FOR THE ACCELERATED LAUNCHING OF LIGHT SAILS

BACKGROUND OF THE INVENTION

This invention relates to devices for simplifying and speeding the launching and simplifying the dousing of light sails such as spinnakers.

Until recently, the launching and dousing of light sails such as spinnakers was an arduous if not dangerous operation. Launching was performed manually in the past by hoisting the sail as it is let out manually from a pile on the deck. Dousing the spinnaker was also achieved manually in the past by lowering it and gathering it in by band. In high wind or heavy seas this was at best an extremely difficult job.

In my earlier patent, U.S. Pat. No. Re. 29,279 reissued from U.S. Pat. No. 3,861,343, and my British patent application No. 7391/76 filed Feb. 25, 1976, I describe devices for aiding the launching and dousing of light sails comprising at least two smooth rings encircling the furled sail at intervals along its height enabling the sail to remain furled while being hoisted and after hoisting until it is desired to launch it. The sail is launched or unfurled by moving the rings upwardly out of encircling engagement with the sail and it can be subsequently doused by moving the rings downwardly into encircling engagement with the sail. The devices of my earlier patent have proven to be highly successful and many have been made and sold since the patent issued.

SUMMARY OF THE INVENTION

The present invention is an improvement on the devices disclosed and claimed in my above-identified reissue patent and British Patent Application, the disclosures of which are incorporated herein by reference. The improvement of the present invention lies in the discovery that launching of the sail can be markedly accelerated by attaching an elastic spacing line to adjacent rings so as to control the distance of spacing between the rings when they encircle the sail in furled condition. When the rings are in their spaced position along the sail the elastic spacing lines are in stretched or loaded condition. When the rings are moved upwardly on the sail during launching the elasticity of the spacing lines provides added upward force on the rings to speed their upward movement. The device of the present invention is especially useful in racing situations when it is desirable to launch the sail quickly and when the boat reaches the most favorable orientation relative to the wind direction and desired course.

Added advantages are provided by the present invention are that the elastic spacing line in relaxed (unstretched) condition at the top of the mast after launching the sail, is considerably shorter than non-elastic spacing lines and is also stiffer, thus resulting in even less likelihood of entanglement. The chance of entanglement when the device is stored off the sail or during handling in installing it on or removing it from the sail is likewise considerably lessened because of the relative shortness and stiffness of the elastic spacing line.

BRIEF DESCRIPTION OF THE DRAWINGS

An embodiment of the present invention is described in detail in reference to the accompanying drawing in which.

DETAILED DESCRIPTION OF THE INVENTION

Figure 1:
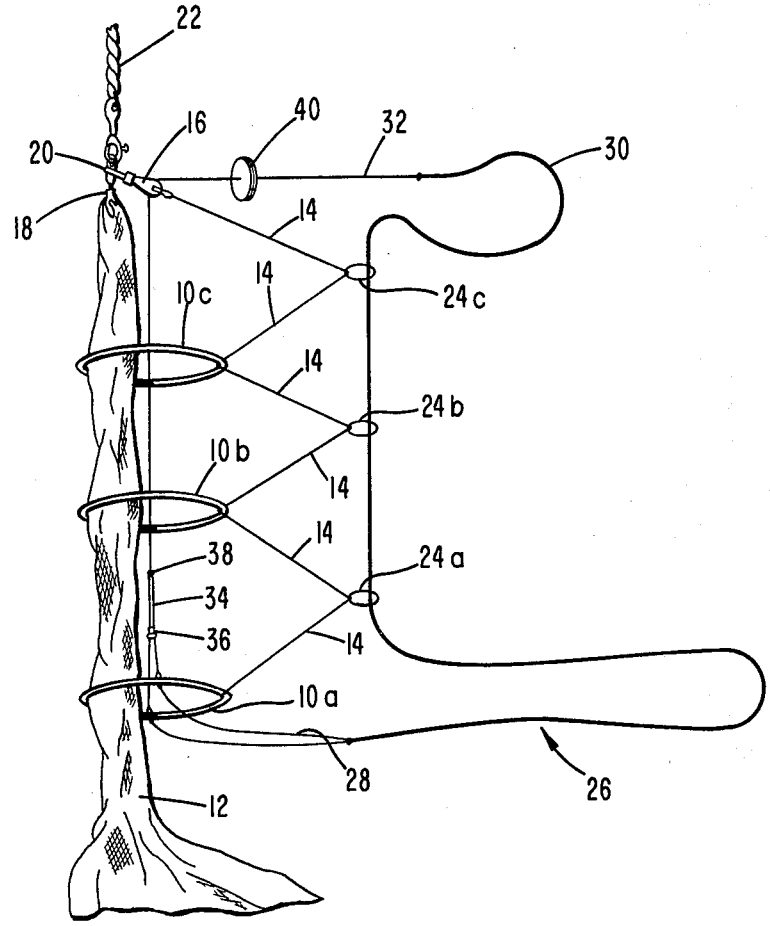
FIG. 1 is a perspective, partially broken away, showing the upper portions of a spinnaker in furled condition but reduced in bulk to show the parts and operation of the device of this invention, the lower portions of the spinnaker being shown in unfurled condition and cutaway.

Referring to FIG. 1 of the drawing, the device of this invention comprises a series of smooth, round, rigid rings 10A, B and C which encircle the furled sail 12 at intervals of from five to ten feet along its height. The size and number of rings 10A, B and C are dependent on the size and weight of the sail 12. The rings 10A, B and C are connected to each other by means of an elastic spacing line 14 the lower end of which is fixed to the lowermost or master ring 10A and the upper end of which is fixed to a single sheave block 16 which is connected to the spinnaker swivel 18 by means of a bow or "D" type shackle 20.

Figure 2:
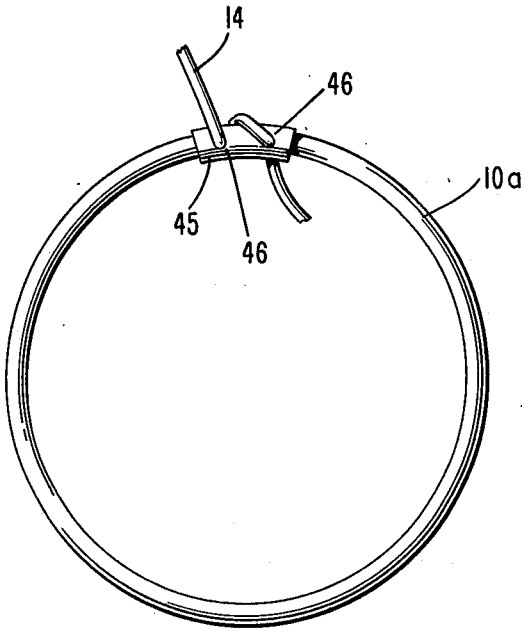
FIG. 2 is a plan view in partial cutaway illustrating one mode of attaching the elastic spacing line to the ring.
Figure 3:
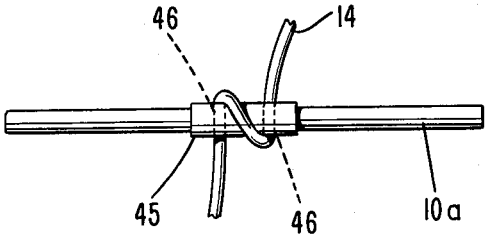
FIG. 3 is an elevational view illustrating the mode shown in FIG. 2.

The spacing line 14 is fixed to each ring 10A, B and C so that the ring does not move along the spacing line. A unitary spacing line 14 can be employed or each elastic spacing line extending between a pair of rings can be separate from the elastic spacing line extending between each different pair of rings and the elastic spacing line extending from the uppermost ring to the block 16. One mode of attachment of a unitary elastic spacing line 14 to each of the rings 10A, B and C is shown in FIG. 2 wherein ring 10A, for example, is formed of a rod of plastic, metal, wood or other suitable material formed into a ring and having its ends connected by a sleeve 45 into which the ends of the rod project. Two holes 46 are drilled through the sleeve 45 and through the end portions of the rods and the elastic spacing line 14 is threaded in one direction through one hole 46, then wound halfway around the sleeve and then threaded through the other hole 46 in the same direction. By this construction, the elastic spacing line 14 holds the sleeve and the end portions of the ring together. Suitable elastic lines for use as spacing line 14 are available. While any such elastic line can be employed, the shock cord type is the most suitable. This type is constructed of an inner core of a plurality of elastic strands covered with braided cotton yarn which is covered with braided polyester or preferably nylon or other plastic yarn to provide abrasion resistance. The braided cotton yarns serve the function of limiting the distance of elongation of the rubber strands to prevent further stretching and to avoid breaking them. The elastic spacing line 14 is capable of maximum elongation of one and a quarter to 2 or more times its original length. One commercially available spacing line is capable of elongation to about 1.8 times its original length, and comprises a core of rubber strands covered with braided cotton which is covered with braided nylon.

In conventional manner, the upper end of the spinnaker is attached to the swivel 18 the swivel eye of which is connected to the spinnaker halyard 22 which is used to hoist or lower the spinnaker 12 in the conventional way. The intermediate ring 10B and the uppermost ring 10C are fixed to the elastic spacing line 14 at different predetermined distances along said line from the block 16 and this locates said rings 10B and 10C at the desired positions along the spinnaker 12 in furled condition. When the rings 10A, B and C are in the desired positions along the furled spinnaker 12, the elastic spacing line 14 is in its extended or stretched condition which can be from one and a quarter to 2 or more times its relaxed length. The stretched elastic spacing line 14 thereby places forces on the rings 10A, B and C tending to raise them and unfurl the spinnaker 12. These forces can be countered by manually holding master ring 10A down as the spinnaker is hoisted. In addition, for added assurance, the lowermost ring 10A can also be tied down by yoke line 28 and halyard 26 (hereinafter described) to prevent upward sliding of the rings 10A, B and C. Thus, at the proper time the ring 10A is released and the stretched spacing line 14 is allowed to spring back to boost upward movement of ring 10A. The stretched length of elastic spacing line 14 is also predetermined so that the lowermost or master ring 10A is located at the desired position along spinnaker 12 in furled condition. It is to be clearly understood that, depending upon the size and weight of the spinnaker 12 there may be no intermediate ring 10B or there may be more than one.

Control bands 24A, B and C encircle and ride freely on the spacing line 14 between each ring 10A, B and C and between uppermost ring 10C and the single sheave block 16. A master ring halyard 26 passes loosely through the control bands 24A, B and C and is attached at its lower end to the center of a yoke line 28 the ends of which are fixed to the master ring 10A at substantially diametrically opposed points. The master ring halyard 26 is constructed of a heavy halyard section 30 spliced to a lighter halyard section 32 of smaller diameter. The lighter halyard section 32 passes through the single sheave block 16 and passes down through the rings 10A, B and C. The free end of the lighter halyard section 32 is fixed to the center of a second yoke line 34 the ends of which are fixed to the master ring 10A at substantially diametrically opposed points. The lighter halyard section 32 is used to conserve weight and the heavy halyard section 30 is used to provide ease of hand gripping. The halyard 26 can be of the same size throughout, if desired, either light or heavy.

A grommet 36 in the shape of a top hat encircles both lengths of said second yoke line 34 between the lighter halyard section 32 and the master ring 10A with the brim of the top hat closest to said master ring. A knot 38 is formed at the juncture of the lighter halyard section 32 and the second yoke line 34. The knot 38 is of sufficient size to prevent the passage of the top hat grommet onto the lighter halyard section 32 but small enough so that it will pass through the single sheave block 16. The brim of the top hat grommet 36 is sufficiently large that it will stop at the single sheave block 16 and will not pass therethrough. A disk 40 having a center hole through which the lighter halyard section freely passes but through which the knot 38 and the heavy halyard section 30 will not pass is mounted on said halyard. The outside dimension of the disk 40 is sufficiently large that the disk will not pass through the single sheave block 16 or through the upper control band 24C. The knot 38 therefore serves, when rings 10A, B and C are raised, to move the disk 40 against the uppermost control band 24C to maintain that section of spacing line 14 extending from control band 24C to block 16 taut and to prevent control band 24C from rising any further on lighter halyard section 32. This also prevents control bands 24A and 24B from rising and thus holds the remaining sections of spacing line 14 substantially taut. In this manner the spacing line 14 is held from entanglement with the sail 12, halyard 26, spinnaker halyard 22 or other gear. Instead of the knot 38 a fishing swivel can be used to secure the lighter halyard section 32 to the center of the second yoke line 34. This serves to prevent twisting of the second yoke line 34 on itself or twisting of the lighter halyard section on itself.

When it is desired to launch or unfurl the spinnaker 12, it is hoisted in furled condition by the halyard 22 and secured in hoisted position. The lower corners of the spinnaker are secured in the usual manner. The rings 10A, B and C are slid upwardly along the furled spinnaker 12 by pulling downwardly on the master ring halyard 26 so as to pull the lighter section 32 through the single sheave block 16. This raises the lowermost ring 10A which collects the rings above it as it ascends. If yoke line 28 and halyard 26 are tied down to prevent accidental raising of the rings, they, of course, should be first released. As the rings 10A, B and C rise they respectively reach narrower portions of the furled spinnaker 12 and the frictional forces between ring and spinnaker drop further below the upward elastic force exerted on the rings by the elastic spacing line 14 providing the rings with extra ease of upward movement to accelerate the rings in clearing the spinnaker. Also, the wind billows the lower portions of the spinnakers it is released by the rising rings to provide extra lift to the lowermost ring 10A further boosting it into contact with the ring above it and so on providing further raising force to the rings. When the rings 10A, B and C reach the top of the spinnaker 12 they are retained there until it is desired to douse the spinnaker.

The top hat grommet 36 serves to control both lengths of second yoke line 34 extending from the knot 38 and grommet 36 as said lengths enter the single sheave block 16 preventing them from moving apart so that both lengths are prevented from slipping off the pulley in the sheave block 16 and also serves to stop ascension of the master ring 10A when it has reached its uppermost position. The top hat grommet 36 can be dispensed with if heavier line is used for the second yoke 34, heavy enough so that it will not slip off the sheave block 16. The control bands 24A, B and C serve to control the spacing line 14 to prevent or decrease the chance of entanglement when the rings 10A, B and C are in their uppermost position and the spacing line 14 is slack.

When it is desired to douse or furl the sail 12, the rings 10A, B and C are slid downwardly around the sail 12 by pulling downwardly on halyard 26 so as to pull the master ring 10A downwardly. The master ring 10A encircles and collapses the spinnaker 12 to spill the wind. Succeeding rings 10B and C follow the master ring 10A and retain the spinnaker 12 in furled condition as they are lowered into position. The spacing line 14 between each ring is of such length that it first stretches and then stops each ring 10B and 10C at the desired position along the length of the sail 12 when the lowermost ring 10A reaches its desired position. As the rings descend on the spinnaker, the uppermost ring 10C stops (because of spinnaker to ring friction) before any substantial stretching of spacing line 14 occurs and before ring 10C reaches its desired lower position along the spinnaker. A similar action occurs successively for each successively lower ring. As the master ring 10A approaches its lowermost desired position the spacing line 14 begins to stretch and as said ring reaches its lowermost desired position the spacing line 14 reaches its maximum desirable stretched condition. The lengths of said spacing line between each successive ring and between the uppermost ring and the block 16 are preselected to avoid undue strain and possible breakage of said spacing line.

As the master ring 10A descends the heavy halyard section 30 engages and moves disk 30 towards the single sheave block 16. The disk 40 engages block 16 and assists in stopping further lowering of master ring 10A just as it reaches its desired lowermost position. This prevents undue strain and possible breakage of the elastic spacing line 14. The spinnaker 12 can be lowered or left hoisted until it is desired to use it again. The condition of the spinnaker 12 when it is furled can be easily observed and any undesirable folding or entanglements thereof are easily corrected at any point along its height.

Sizes are not critically important. The rings 10A, B and C are satisfactorily 6 or less to 12 or more inches in inside diameter and made of three-eighths inch stock. The inside diameter of the rings 10A, B and C will depend upon the size of the sail and should be large enough to be capable of being slid upwardly and downwardly on the sail but small enough to engage the sail around the inner periphery of the rings to hold the sail in furled condition. Thus, for very large sails the inside diameter of the rings 10A, B and C can be greater than 12 inches, e.g., 14, 16 or 18 inches or more, and, for small sails, it can be less than 6 inches. In the usual cases, 3 to 10 rings 10A, B and C are adequate in the device of this invention. It is preferred that the surfaces of rings 10A, B and C be as smooth as possible and that they be as thin as possible consistent with providing adequate strength. While the device of this invention has been explained with reference to a spinnaker, it can be applied equally well to any other light sail such as jibs or staysails. The rings 10A, B and C are satisfactorily made of polyurethane which provides strength, light weight and smooth surfaces.

Modifications can be made to the device shown in the drawing. For example, the downhaul yoke line 28 can be eliminated and the halyard 26 can be directly attached to the master ring 10A. Also, yoke line 36 preferably is attached to opposite ends of a minor chord, i.e., at points on the ring that are separated by a straight line shorter than the diameter. This minimizes chafing and rubbing of the yoke line 36 on the sail during the furling operation since the sail tends to enter the ring at diametrically opposed sides of the ring. In addition, it is preferable to eliminate knots or any other protrusions on the ring to minimize friction and abrasion on the sail. Furthermore, the rings 10A, B and C preferably are made of nylon because nylon is lighter in weight than polyurethane.

What is claimed is:

1. In a device for launching a light sail connected to the mast of a sailing vessel comprising at least two rings spaced from each other along the length of said sail and encircling said sail in furled condition, each said ring being of a size which, when positioned on the sail in the furled condition, provides upwardly slideable engagement with the sail, the lowermost ring engaging the lower portions of the sail, the uppermost ring engaging the upper portions of the sail and any intermediate ring or rings engaging intermediate portions of the sail when in the furled condition to retain said sail in furled condition, spacing line attached to each ring and the ring above it for positioning the rings at desired spaced apart positions along said sail in furled condition, and means for raising the lowermost ring into engagement with the next ring above it to raise said next ring and successively to raise all rings to slide said rings upwardly along said sail to disengage all rings from the sail and thereby launch the sail, the improvement wherein said spacing line is elastic and its length in stretched condition is at least one and one quarter times its relaxed length, said elastic spacing line being in stretched condition when said rings are in said desired spaced apart positions and urging said rings upwardly to speed the upward movement of said rings when said sail is launched, said elastic spacing line in relaxed condition being shorter and stiffer and being more capable of resisting entanglement than spacing line that is not stretchable to at least one and one quarter its relaxed length.

2. Device as claimed in claim 1 wherein there is also provided means for lowering the rings beginning with the lowermost ring in succession into sliding encircling engagement with said sail forcing same into furled condition to position said rings in the aforementioned spaced apart positions to retain said sail in furled condition.

3. Device as claimed in claim 2 wherein said lowering means is a line attached to said lowermost ring.

4. In a device for launching a light sail connected to the mast of a sailing vessel comprising at least two rings spaced from each other along the length of said sail and encircling said sail in furled condition, each said ring being of a size which, when positioned on the sail in the furled condition, provides upwardly slideable engagement with the sail, the lowermost ring engaging the lower portions of the sail, the uppermost ring engaging the upper portions of the sail and any intermediate ring or rings engaging intermediate portions of the sail when in the furled condition to retain said sail in the furled condition, a block connected to the upper end of said sail, a halyard connected at one end to the lowermost ring and passing upwardly through any intermediate rings and said uppermost ring, through said block and down toward the deck outside of said rings, said halyard being used for raising the lowermost ring into engagement with the next ring above it to raise said next ring and successively to raise all rings to slide said rings upwardly along said sail to disengage all rings from the sail and thereby launch the sail, a spacing line connected at its upper end to the upper end of said sail and attached at its lower end to said lowermost ring, said uppermost ring and any intermediate rings being connected to said spacing line at intermediate spaced apart points to position said rings at predetermined locations along the length of the sail in furled condition when said lowermost ring is in its lowermost location and control bands encircling and riding freely on the spacing line at points between each ring and between the uppermost ring and the upper end of the spacing line, said control bands encircling that portion of said halyard extending from the block toward the deck and serving to control said spacing line against entanglement when the rings are in the uppermost position and the sail is in unfurled condition, the improvement wherein said spacing line is elastic and its length in stretched condition is at least one and one quarter times its relaxed length, said elastic spacing line being in stretched condition when said rings are in said predetermined locations and urging said rings upwardly to speed the upward movement of said rings when said sail is launched, said elastic spacing line in relaxed condition being shorter and stiffer and being more capable of resisting entanglement than spacing line that is not stretchable to at least one and one quarter its relaxed length.

5. Device as claimed in claim 4 wherein the other end of said halyard is connected to the lowermost sail-encircling ring for lowering said lowermost ring and any intermediate sail-encircling ring and said upper sail-encircling ring into sliding encircling engagement with said sail forcing same into furled condition.

6. Device as claimed in claim 4 or 5 wherein said halyard is connected to said lowermost sail-encircling ring through a yoke line the ends of which are attached to substantially diametrically opposed sides of the ring and the center of which is attached to one end of the halyard.

7. Device as claimed in claim 5 wherein said halyard is provided with a stop small enough to pass through said block and located at a point on said halyard that is between the block and the lowermost said-encircling ring, and a disk large enough not to pass through the uppermost control band and having a hole through which said halyard passes but said stop does not, said disk being mounted on said halyard between the uppermost control band and the block, and adapted to prevent said control bands from rising on the halyard toward said block when the lowermost sail-encircling ring is in its uppermost position.

8. Device as claimed in claim 4 wherein said halyard is connected to the lowermost sail-encircling ring through a yoke line comprising a short line the ends of which are attached to said lowermost sail-encircling ring at substantially diametrically opposed points and the center of which is attached to one end of said halyard, a grommet slideably encircling both lengths of said yoke line which extends from said one end of the halyard to said lowermost sail-encircling ring.

* * * * *